US008429874B2

(12) United States Patent
Schneider

(10) Patent No.: US 8,429,874 B2
(45) Date of Patent: Apr. 30, 2013

(54) DOUBLE-Y MODULAR FRAMING RHOMBICUBOCTAHEDRON CONSTRUCTION SYSTEM

(76) Inventor: David G. Schneider, Louisville, KY (US)

( * ) Notice: Subject to any disclaimer, the term of this patent is extended or adjusted under 35 U.S.C. 154(b) by 0 days.

(21) Appl. No.: 13/065,951

(22) Filed: Apr. 4, 2011

(65) Prior Publication Data

US 2012/0247054 A1 Oct. 4, 2012

(51) Int. Cl.
*E04H 12/00* (2006.01)

(52) U.S. Cl.
USPC ..... 52/653.1

(58) Field of Classification Search ..... 52/646, 52/637, 656.1, 86, 90.1; 446/85, 118, 119, 446/124, 126; 403/169, 170, 171, 176
See application file for complete search history.

(56) References Cited

U.S. PATENT DOCUMENTS

| | | | | |
|---|---|---|---|---|
| 1,347,808 | A | 7/1920 | Franklin | |
| 2,609,638 | A | 9/1952 | Lindenmeyer | |
| 3,347,000 | A | 10/1967 | Smith | |
| 3,722,153 | A * | 3/1973 | Baer | 52/81.2 |
| 3,726,027 | A * | 4/1973 | Cohen et al. | 434/98 |
| 3,830,011 | A | 8/1974 | Ochrymowich | |
| 3,939,581 | A * | 2/1976 | Clarke, Jr. | 434/278 |
| 4,129,975 | A * | 12/1978 | Gabriel | 52/655.2 |
| 4,274,222 | A | 6/1981 | Zahn et al. | |
| 4,288,947 | A | 9/1981 | Huang | |
| 4,903,452 | A | 2/1990 | Haung | |
| 5,326,337 | A | 7/1994 | Pardella | |
| D355,589 | S | 2/1995 | Kuwata | |
| 5,390,452 | A * | 2/1995 | Eckert | 52/71 |
| 5,640,811 | A | 6/1997 | Boyle et al. | |
| D384,988 | S | 10/1997 | Schmidt | |
| 5,958,172 | A | 9/1999 | Levingston | |
| 5,961,365 | A * | 10/1999 | Lambert | 446/125 |
| 6,282,849 | B1 * | 9/2001 | Tuczek | 52/81.1 |
| 6,379,212 | B1 * | 4/2002 | Miller | 446/85 |
| D477,527 | S | 7/2003 | Bradford | |
| 6,869,246 | B2 | 3/2005 | Bridgers | |
| 6,921,314 | B2 * | 7/2005 | Miller | 446/85 |
| 7,241,072 | B2 | 7/2007 | Patrignani | |
| 7,316,598 | B1 | 1/2008 | Lock | |
| 7,641,534 | B2 | 1/2010 | Holman | |
| 2005/0245167 | A1 | 11/2005 | Sinisi | |

OTHER PUBLICATIONS

Photograph of geometric structure by David Schneider published in Courier Journal newspaper on Oct. 3, 1982.

* cited by examiner

*Primary Examiner* — Joshua J Michener
*Assistant Examiner* — Keith Minter
(74) *Attorney, Agent, or Firm* — Carrithers Law Office PLLC

(57) ABSTRACT

A construction system using framing components in the shape of a double-Y member wherein two longitudinal members which are connected to form a right angle are then connected to one end of a third longer longitudinal member at the vertex of the pair. Another pair is connected at the other end of the longer member, thus forming a Y-shape at each end and wherein all five longitudinal members are co-planar. Multiple ones of these double Y elements are joined at the ends of the double Y, each double-Y element being rotated 90° before joining to the next one. The resulting construction yields a three dimensional framework which defines a repeating pattern of volumetric shapes which all fall into one of two categories: cubes and rhombicuboctahedrons (a 26 sided three dimensional shape which can be described as a cube which has been mitered at each corner and each edge).

22 Claims, 8 Drawing Sheets

DOUBLE-Y MODULAR FRAMING RHOMBICUBOCTAHEDRON CONSTRUCTION SYSTEM

TECHNICAL FIELD

The present invention relates to the field of structural building based on modular concepts where a small number of basic building components are used to quickly and easily construct three dimensional structures.

BACKGROUND OF THE INVENTION

Construction systems for building any sort of three dimensional structures can be modular, non-modular or a combination of both. Construction methods which don't use modular concepts have the advantage over modular type construction of being almost unlimited as to the overall design features. However, construction systems involving modular concepts have many advantages over construction systems which are not modular in design. These advantages include the speed of design and construction, fewer types of building elements needed, the ease of future expansion, and the ease of disassembly and modification, to name a few.

The types of construction elements which are needed in modular construction are framing elements used to construct a framework and panel elements which are supported by and connected to that framework to enclose volumes. Modular construction systems using fewer sizes and shapes of these construction elements without drastically limiting the design of the overall shape of a structure or internal substructures are preferable over more complex modular systems.

DESCRIPTION OF THE RELATED ART

U.S. Pat. No. 5,958,172 by Livingston for JOINTS FOR POLYMERIC PIPE issued on Sep. 28, 1999 shows a construction approach using joining member for pipe or tubular members to generate differing piping layouts but does not use the double Y element as used in the present invention and does not provide for enclosing spaces within a given structure.

U.S. Pat. No. 4,288,947 by Huang for Modular Inflatable Dome Structure which issued on Sep. 15, 1981 uses Y joints to connect longitudinal members of one length resulting in pentagonal and hexagonal structures. Huang's Y connectors have branches forming angles 120, 120 and 108 degrees and is not coplanar as is the double-Y element provided by the present invention and does not provide for enclosing spaces within a given structure.

SUMMARY OF THE INVENTION

In accordance with the present invention, there is provided a double-Y modular framing construction system comprising a plurality of double-Y elements, small first cubic corner panel portions, large second cubic corner panel portions, small first rhombicuboctahedral corner panel portions and large second rhombicuboctahedral corner panel portions. The plurality of double-Y elements are connected at the endpoints of respective double-Y elements at right angles to one another. The plurality of double-Y elements forms a framework circumscribing a plurality of volumes in three specific shapes including a small cube, a large cube and a rhombicuboctahedron. Each of the double-Y elements comprises four short longitudinal elements of a given length A, one long longitudinal element of a length equal to the square root of two multiplied by A, and two modular Y joints wherein a first free end of a first two of the four short longitudinal elements and a first free end of the long longitudinal element are connected to the three ends of a first of the two modular Y joints. The first two longitudinal elements form a 90° angle with one another and the long longitudinal element forms a 135° angle with each of the first two short longitudinal elements. A second one of the two modular Y joints is connected to the first free ends of a second two of the four short longitudinal elements and to the free end of the long longitudinal element. The second two short longitudinal elements form a 90° angle with one another and the long longitudinal element forms a 135° angle with each of the second two short longitudinal elements. Selected ones of the panel portions are assembled to enclose the three specific shapes including a small cube, a large cube and a rhombicuboctahedron within the double-Y framework.

The present invention provides a construction system using framing components in the shape of a double-Y member wherein two longitudinal members which are connected to form a right angle are then connected to one end of a third longer longitudinal member at the vertex of the pair. Another pair is connected at the other end of the longer member, thus forming a Y-shape at each end of the longer longitudinal member forming an over all 'double-Y' shaped element and wherein all five longitudinal members are co-planar.

The modular construction system provided by the present invention is quite adaptable for use as a child's toy set, but it is further anticipated that the modular construction system of the present invention will be used in the construction of living spaces for modern urban housing. However, due to the advantages of quick and easy assembly and disassembly inherent in the double-Y construction system, this system is a natural choice for building living units for space exploration, military camps, housing and the like.

It is an object of this invention to provide a modular framing system containing only three framing elements: a Y joint, a short longitudinal element and a long longitudinal element to build a framework.

It is an object of this invention to provide a modular construction system wherein the framework built using this system is comprised of double-Y elements made by connecting two Y joints to a longer longitudinal element and then connecting four shorter longitudinal elements at each of the four free ends of the two Y joints, thus forming a coplanar double-Y framing element.

It is an object of this invention to provide a modular construction system wherein double-Y elements are assembled to one another in a configuration which encloses volumes with two general shapes: cubes and rhombicuboctahedrons (a 26 sided volume), all of which can be connected and combined to form larger volumes.

It is an object of this invention to provide a modular construction system wherein only four types of panel modules are needed which can be supported by and connected to a framework to enclose volumes within the framework which form cubes, rhombicuboctahedrons, and substructures and combinations of these.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a construction system based on a framing element in the shape of a double-Y. Framework built by assembling the double-Y elements outlines a repeating pattern of volumetric shapes which all fall into one of two categories: cubes and rhombicuboctahedrons (a 26 sided three dimensional shape which can be described as a cube which has been mitered on each corner and each edge). While there are two different sized cubic volumes defined by the framework, only one size of rhombicuboctahedron is defined by the double-Y framework.

Figure 1:
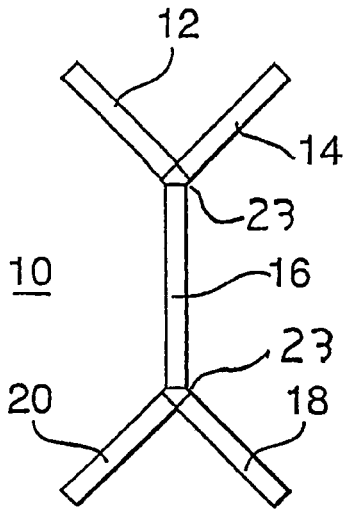
FIG. 1 is a top view of a double-Y element.
Figure 2:
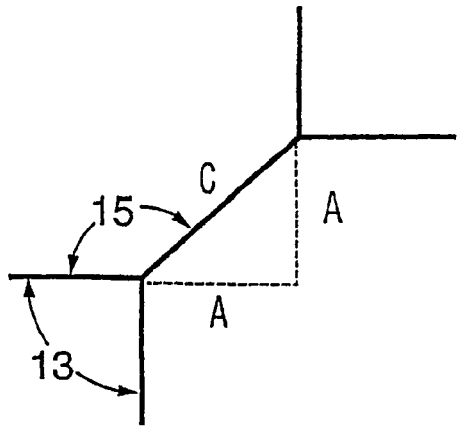
FIG. 2 is a single line drawing of the double-Y element showing respective elemental lengths and angles.
Figure 3:
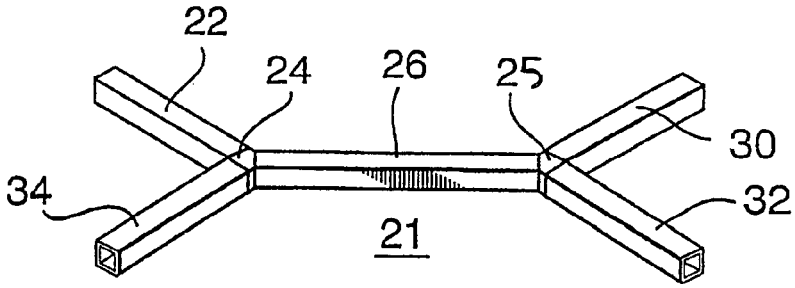
FIG. 3 is a perspective view of a double-Y element made from two Y joints and five longitudinal members.

The double-Y construction system is based on the double-Y framing element shown in FIG. 3. FIGS. 1 and 3 show a simple drawing of a double-Y element 10 comprising five longitudinal elements. As shown in FIG. 2, the angle 13 between elements 12 and 14 and between 18 and 20 is 90°. The angle 15, between element 16 and any of the four other elements is 135°. Longitudinal elements 12, 14, 18 and 20 are equal in length and longitudinal element 16 is longer. With elements 12, 14, 18 and 20 being of length A, then element 16 is the square root of two times A in length, as given by the Pythagorean theorem in reference to the triangle in FIG. 2. The resulting double-Y element is coplanar. In other words, all of the elements 12, 14, 16, 18 and 20 are in the same plane.

While the preferred length of the long longitudinal element is equal to the square root of two times A, as given by the Pythagorean theorem as applied to FIG. 2, other lengths are possible and will yield enclosed volumes with similar cubic and rhombicuboctahedral shapes but with sides differing in size from those with the preferred length.

Figure 4:
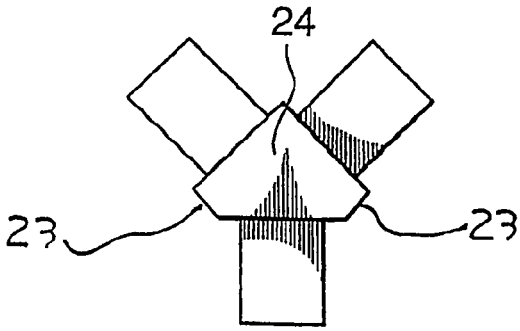
FIG. 4 is a front view of a Y joint.
Figure 5:
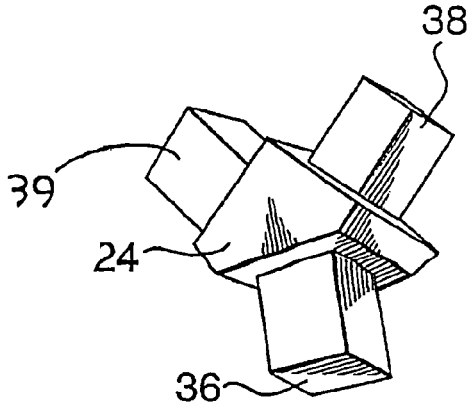
FIG. 5 is a perspective view of a Y joint.

FIGS. 4 and 5 show modular Y joint 24 with lugs 36, 38 and 39. It can be noted that lugs 38 and 39 are positioned 90° to one another and that lug 36 forms a 135° angle with each of lugs 38 and 39.

The double-Y element 21, in FIG. 3, is composed of five square tubes 22, 26, 30, 32 and 34 and two Y joints 24 and 25. Y joint 24 is shown in FIGS. 4 and 5. Square tubes 22, 30, 32 and 34 are of length 'A'. Square tube 26 has a length of A multiplied by the square root of 2, or approximately 1.414 times A. One end of each of tubes 22 and 34 is pressed onto square lugs 38 and 39 respectively, of Y joint 24. One end of square tube 26 is pressed onto lug 36. This forms one Y. Now one end of each of tubes 30 and 32 is pressed onto lugs 38 and 39 of a Y joint 25. Finally, lug 36 of the second Y joint 25 is pressed into the free end of square tube 26.

Figure 16:
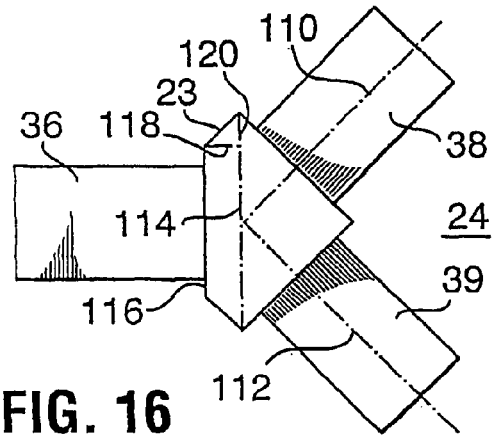
FIG. 16 is a front view of a Y joint showing edge 23 of length C.

With close attention to FIGS. 1 and 4 it can be seen that edges 23 are collinear with the edges of tubes 22, 34, 30 and 32. The preferred length for edge 23 provides a smooth transition between all five longitudinal members with the Y-joints 24 and 25 as shown in FIGS. 1 and 3. A preferred length for edge 23 can be found as follows. In FIG. 16, edges 115 and diagonal 114 form an isosceles right triangle. If edges 115 have a length equal to D, then diagonal 120 has a length C equal to the square root of two times D. Edge 116 is equal in length to edges 115. A smaller isosceles right triangle is formed by edge 23 having a length B and sides 118 and 120 having a length A. The length B of edge 23 is given below.

$$
\begin{aligned}
B &= \text{the square root of} \times A \\
&= ((\text{the square root of } 2)/2) \times (C - D) \\
&= ((\text{the square root of } 2)/2) \times ((\text{the square root of } 2 \times D - D) \\
&= ((\text{the square root of } 2)/2) \times (\text{the square root of } 2 - 1) \times D \\
&= (2 - \text{the square root of } 2)/2 \times D \\
&= \text{approximately } .293 \times D
\end{aligned}
$$

Therefore, the preferred length of edge 23 is 0.293×D or 0.293 times the outside width of the square tubing.

Figure 6:
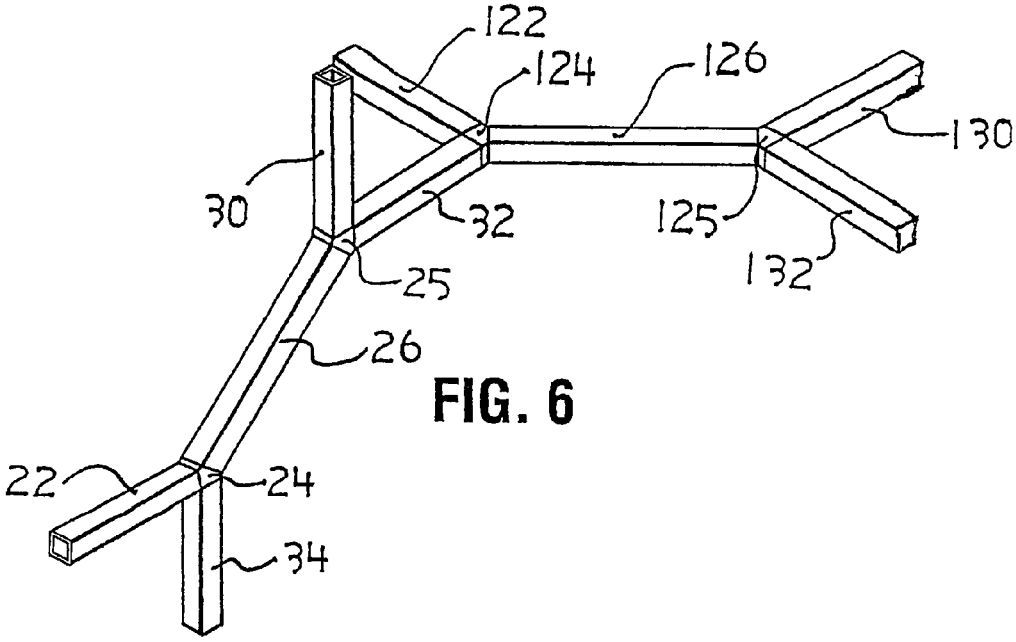
FIG. 6 is a perspective view of two double-Y elements joined with a 90° rotation of one double-Y with respect to the other
Figure 17:
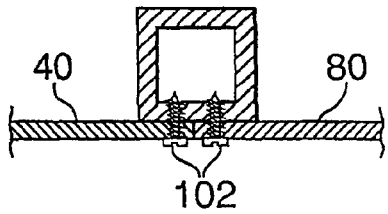
FIG. 17 is a cross sectional view showing the edges of panel portions attached to a flat side of a tubing section.
Figure 19:
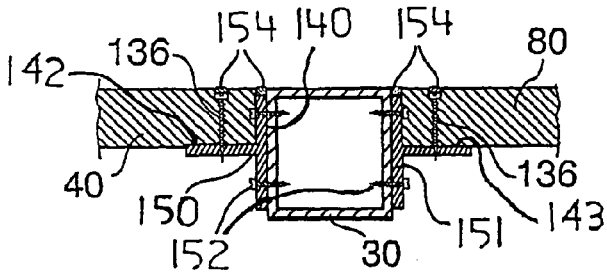
FIG. 19 is a cross sectional view showing panel portions attached to alternative T-flanges which are attached to opposing sides of a tubing section.
Figure 18:
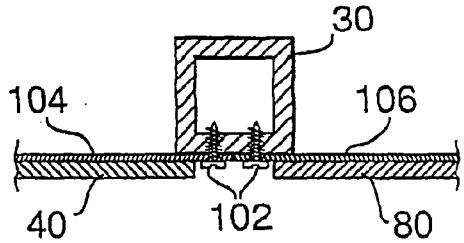
FIG. 18 is a cross sectional view showing panel portion edges fitted with flanges and attached to a flat side of a tubing section.

It is anticipated that the tubing and lugs may be other than square. Round, octagonal or any shape that provides the ability to assemble double-Y elements at 90° to one another, as shown in FIG. 6, is acceptable. The preferred tubing and lugs are square because this aids in performing the 90° rotation properly when assembling two double-Y elements. Further, square tubing provides a flat surface along which the edges of the panel members meet and to which panel members can easily be attached with or without the use of flanges, as seen in FIGS. 17-19.

When two double-Y elements are assembled, they share a common short longitudinal square tube. In particular, with reference to FIG. 6, two double-Y elements are assembled. The first element is composed of tubes 22, 34, 26, 30 and 32 and Y joints 24 and 25. The second double-Y element is composed of tubes 32, 122, 126, 130 and 132 and Y joints 124 and 125. Both double-Y elements contain tube 32. Further, whenever two double-Y elements are joined, the combination is not co-planar, because the first double-Y is rotated 90° before being joined to the second double-Y element.

Figure 9:
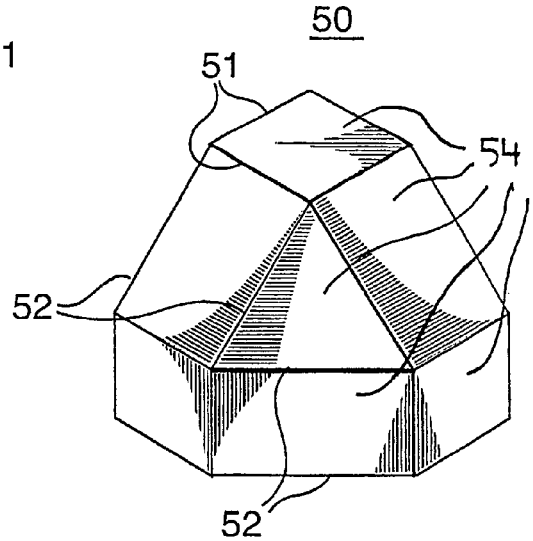
FIG. 9 is a perspective view of a small rhombicuboctahedral corner panel element.
Figure 10:
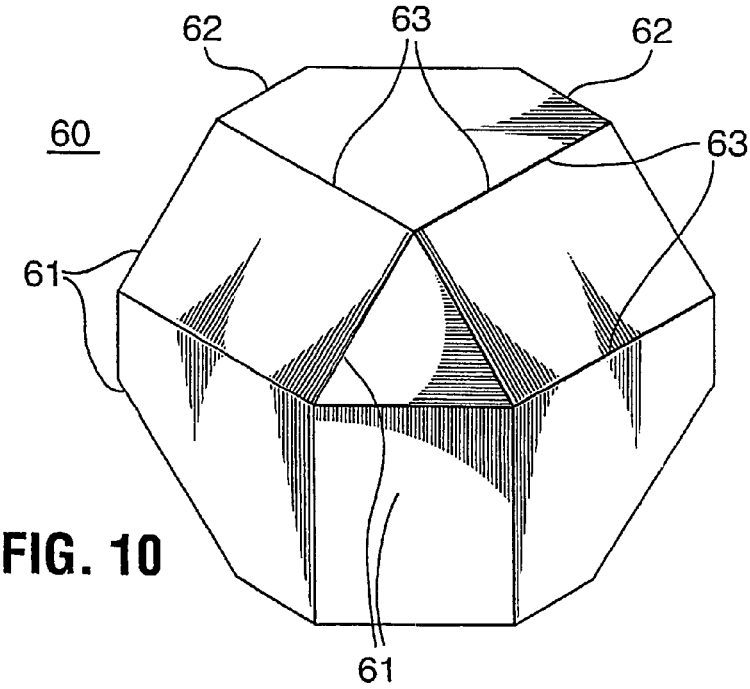
FIG. 10 is a perspective view of a large rhombicuboctahedral corner panel element.
Figure 11:
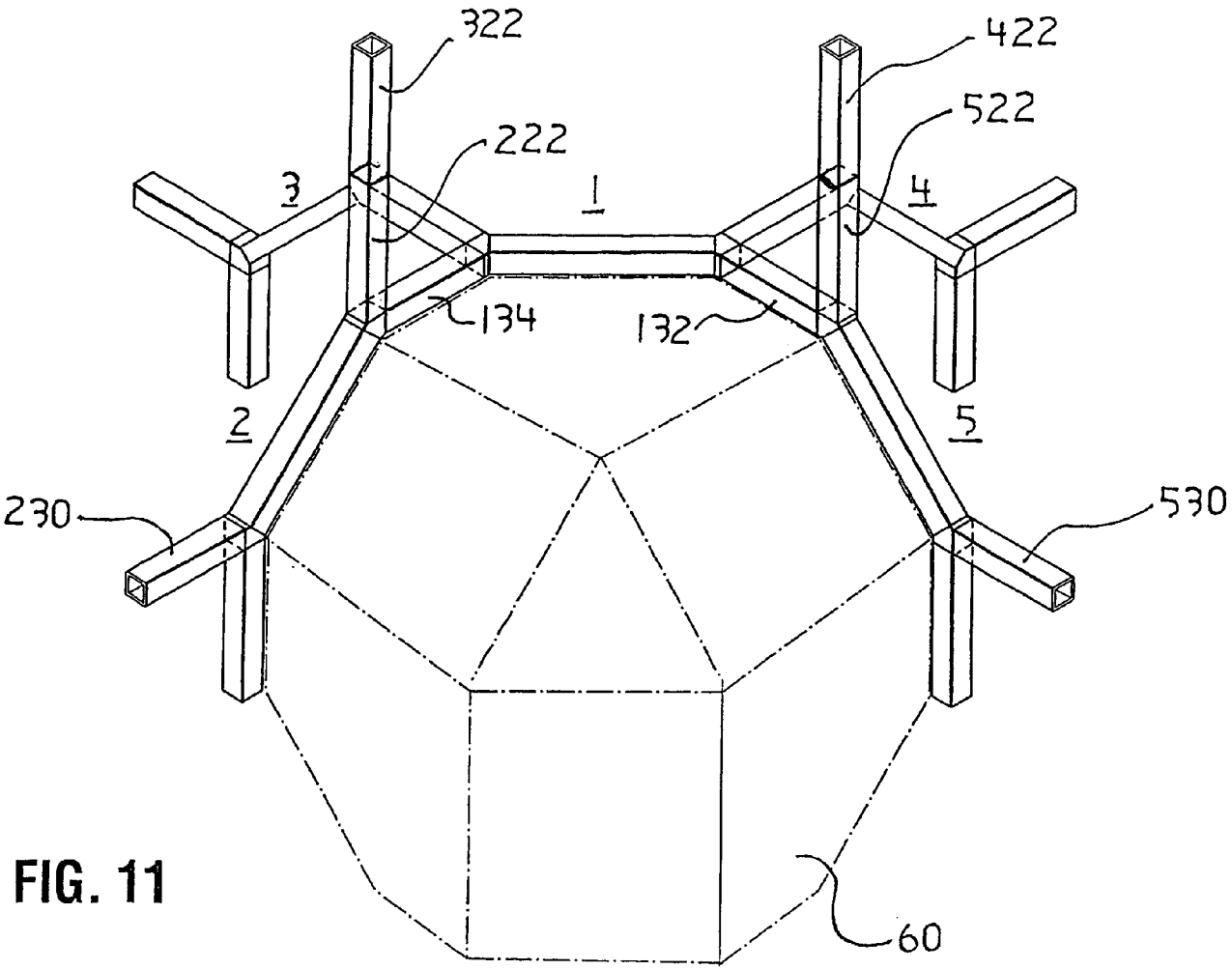
FIG. 11 is a perspective view of five double-Y elements forming a framework portion circumscribing a portion of a large rhombicuboctahedral corner panel element.
Figure 12:
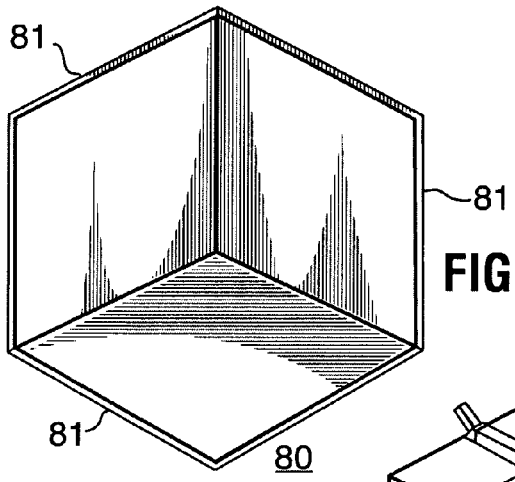
FIG. 12 is a perspective inside view of a small cubic corner panel element.
Figure 14:
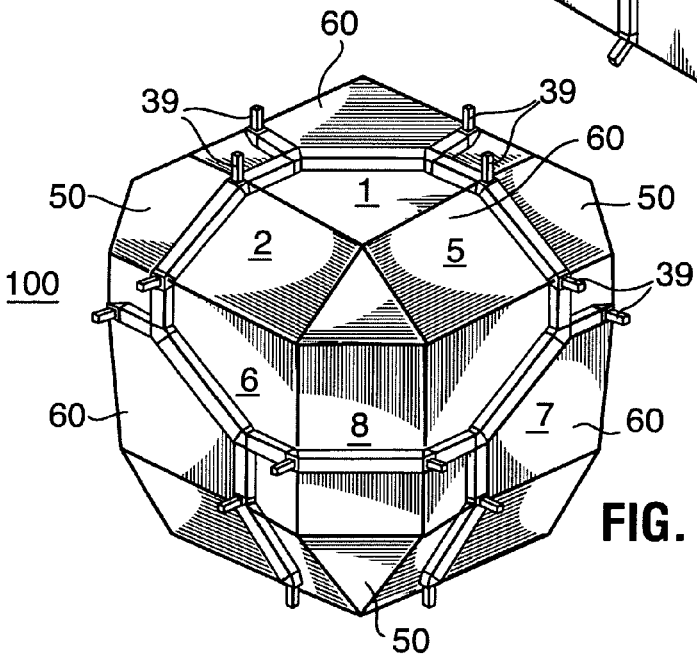
FIG. 14 is a perspective view of a rhombicuboctahedron circumscribed and supported by a double-Y framework.

FIG. 9 shows a small first rhombicuboctahedral corner element 50 containing edges 51 and 52 and faces 54 which are thin walls such that the overall element 50 is not a solid figure but effectively hollow, as is cubic corner element 80 shown in FIG. 12. Edges 51 are equal in length to short longitudinal elements 22, 30, 32 and 34, and edges 52 are equal in length to long longitudinal element 26, as can be seen comparing FIGS. 3, 6 and 11. FIG. 10 is a large second rhombicuboctahedral corner element 60 with edges 62 and 63 and a plurality of faces as well. Edges 62 are equal in length to short longitudinal elements 22, 30, 32 and 34. Edges 61 are equal in length to long longitudinal element 26. A complete rhombicuboctahedran 100 as shown in FIG. 14, is composed of four small rhombicuboctahedral corner elements 50 and four large rhombicuboctahedral corner elements 60. A framework of double-Y elements including double-Y elements 1, 2, 5, 6, 7 and 8, circumscribes the entire rhombicuboctahedron 100 such that the long and short longitudinal elements of the double-Y elements are adjacent to and attached to the marginal edges of the small and large rhombicuboctahedral corner elements 50 and 60. Attachments means are shown in FIGS. 17-19.

With reference to FIG. 11, an assembly of five double-Y elements is shown. Double-Y elements 2, 3, 4 and 5 have been joined to double-Y element 1. Double-Y elements 1 and 2 share short longitudinal element 134 and double-Y elements 1 and 5 share short longitudinal element 132. The upper marginal portion of a large rhombicuboctahedral corner section 60 is circumscribed by double-Y elements 1, 2 and 5, as shown. FIG. 14 shows an enhancement of FIG. 11 wherein further double-Y elements 6-8, further panel portions 60, and small corner elements 50 have been added to build rhombicuboctahedron 100. It is understood that this is a perspective drawing of a three dimensional 26-sided figure and that further double-Y elements and small and large corner elements 50 and 60 would appear when rhombicuboctrahedran 100 is viewed from the rear side. It is further understood that rhombicuboctrahedran 100 is a hollow structure made from a framework of double-Y elements and panel portions as shown in FIGS. 9 and 10. The tubal elements 222, 322, 422, 522, 230 and 530 in FIG. 11 which stick out from the structure, do not support any edges of any panel portions, and are unnecessary to support rhombicuboctahedron 100 and therefore have been omitted from FIG. 14, but could be added to extend and expand the structure. As shown in FIG. 14, when these tubing elements are removed, lugs 39 will then be left protruding from the outside of rhombicuboctrahedran 100.

Figure 7:
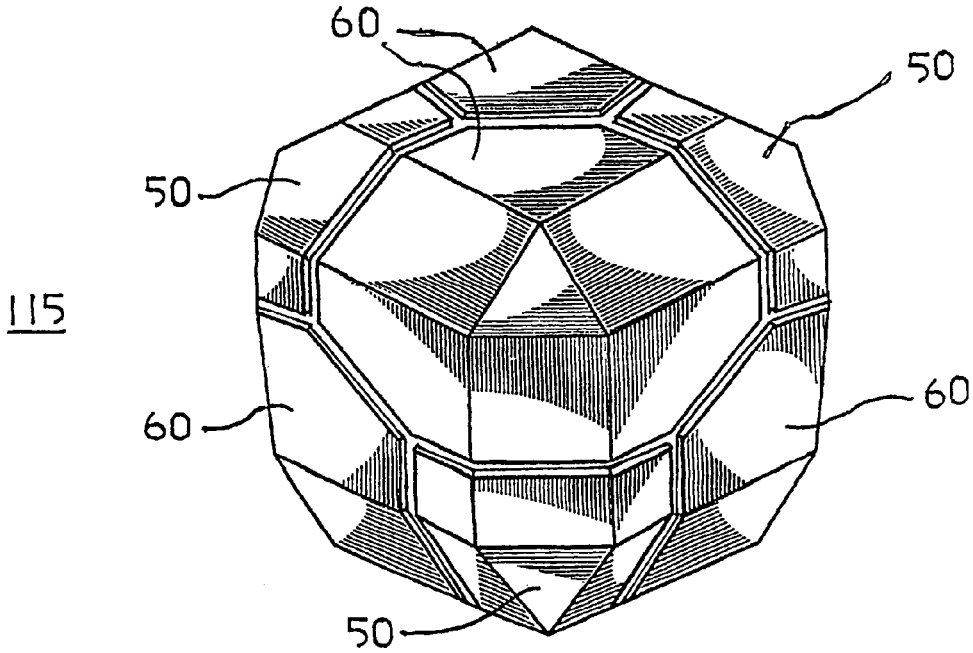
FIG. 7 is a perspective view of corner pieces positioned to form a rhombicuboctahedron.

FIG. 7 shows rhombicuboctahedron 115 which is the same as rhombicuboctahedron 100 in FIG. 14 except that there is no supporting framework composed of double-Y elements. As shown, rhombicuboctahedron 115 is just a collection of small rhombicuboctahedral corner elements 50 and large rhombicuboctahedral corner elements 60. Without the double-Y framework, rhombicuboctahedron 115 is unsupported will fall to pieces.

Figure 8:
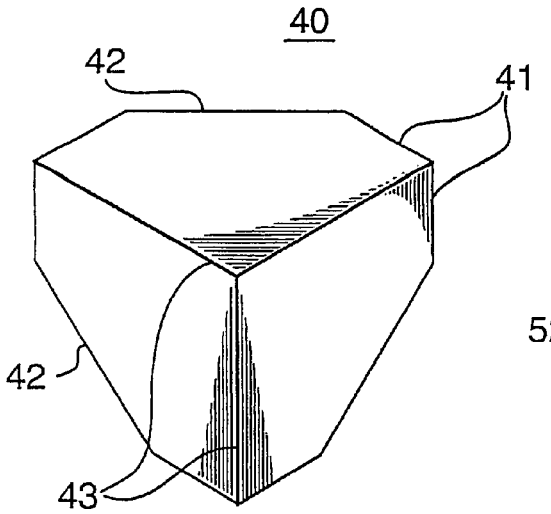
FIG. 8 is a perspective view of a large cubic corner panel element.

FIG. 12 shows an inside perspective view of a small first cubic corner element 80 composed of three square faces, the edges of which are equal in length to short longitudinal elements 22, 30, 32 and 34, and the square faces of which have a thickness FIG. 8 shows a large second cubic corner element 40 including three faces and edges 41, 42 and 43. With reference also to FIG. 3, edges 41 are equal in length to short longitudinal elements 22, 30, 32 and 34. Edges 42 are equal in length to long longitudinal element 26. It is understood that the faces of both small cubic corner element 80 and large cubic corner element 40 are thin walls such that elements 40 and 80 are not solid but are effectively hollow, as shown in FIG. 12.

Figure 13:
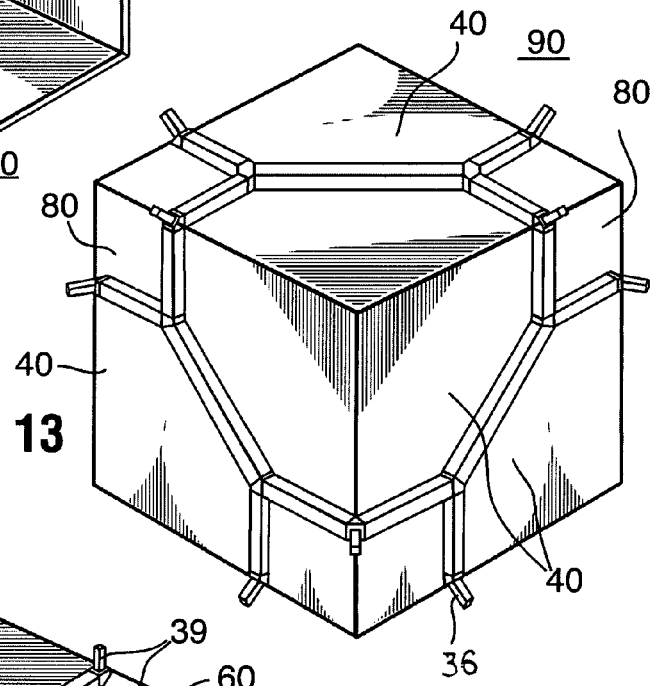
FIG. 13 is a perspective view of a cubic structure circumscribed and supported by a double-Y framework.
Figure 15:
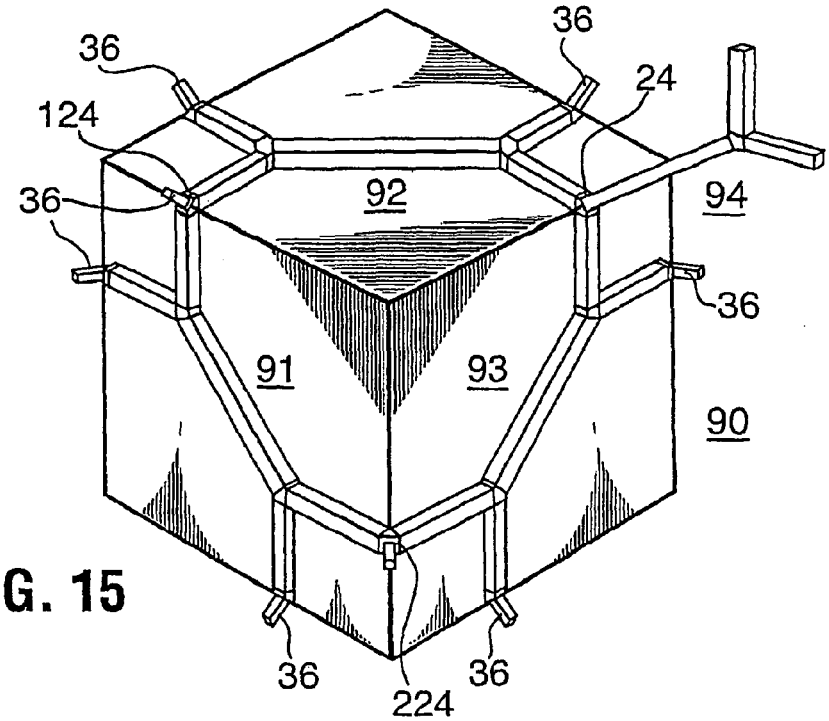
FIG. 15 is a perspective view of the cube of FIG. 13 with double-Y framework expanded.

FIGS. 13 and 15 show a complete cubic structure 90 built from a framework of double-Y elements, four small cubic corner elements 80 and four large cubic corner elements 40. Cube 90 is hollow with exterior walls defined by small and large cubic corner elements 40 and 80. As shown in FIG. 13, the framework defined by double-Y elements 91-93 circumscribes cube 90. It is understood that three additional double-Y elements, which are not shown on the rear side of cube 90, but combine with double-Y elements 91-93 to complete the framework required to support the cube 90. As shown in FIG. 17, the marginal edges of panel portions such as panel portions 40 and 80 meet adjacent to one flat surface of the square tubing longitudinal members of the double-Y elements and are attached with self drilling screws 102. Another embodiment of the construction system shown in FIG. 18 has flanges 104 and 106 attached to panel portions 40 and 80. Then the flanges are attached to the longitudinal members with self drilling screws 102. It is anticipated that the panel portions may be attached to the square tubing surfaces by gluing, welding, bolts and nuts or any appropriate attachment method.

FIG. 15 shows the beginning of an expansion of the structure in FIG. 13, where double-Y element 94 has been connected to Y-joint 9424 at the junction between double-Y elements 92 and 93. Y-joints 24, 124 and 224 have been added to hold double-Y elements 91, 92 and 93 together. Further combinations of double-Y elements can be added at protruding lugs 36 of cube 90 to expand the structure in FIG. 15 to enclose additional volumes as desired.

The edges of panel portions 50 and 60 in FIG. 14 and panel portions 40, and 80 in FIGS. 13 and 15 meet alongside those particular flat sides of longitudinal members 22, 26, 30, 32 and 34 which face toward the cubic or rhombicuboctahedral volumes as shown in FIGS. 13-15. FIG. 17 shows a method of attaching panel portions 40 and 80, for example, to longitudinal member 30 with self drilling screws 102. FIG. 18 shows another method wherein, the edges of panel portions 40 and 80 are fitted with flanges 104 and 106, respectively. Then, self drilling screws 102 are used to attach flanges 104 and 106 to longitudinal member 30.

A further embodiment of the present invention including an alternative flange configuration is shown in FIG. 19. T-flanges 150 and 151 are attached to opposing sides of square tubing 30 with self drilling screws 152. The flat surface 140 of T-flange 150 is attached to a lateral surface of tubing 30. Panel portion 40 is attached to the lateral surface 142 of T-flange 150 with self drilling screw 136. Panel portion 80 is attached to the lateral surface 143 of T-flange 151 with self drilling screw 136. To provide an air tight or water tight joining of the panels portions and tubing members, sealant 154 is applied to seal the areas where the panels 40 and 80 meet the tubing 30 and flanges 150 and 151 and to seal the heads of screws 136. In this embodiment, all marginal edges of all rhombicuboctahedral corner elements in a given rhombicuboctahedran are attached to the adjacent double-Y tubing members using T-flange members and self-drilling screws. Sealant is applied to seal all desired joints as required.

Sealant 154 is used on all the adjoining edges of corner panel portions which are attached to the inward facing surfaces of the cubic or rhombicuboctahedral volumes for the purpose of providing a water tight and gas tight volume as desired.

Figure 20:
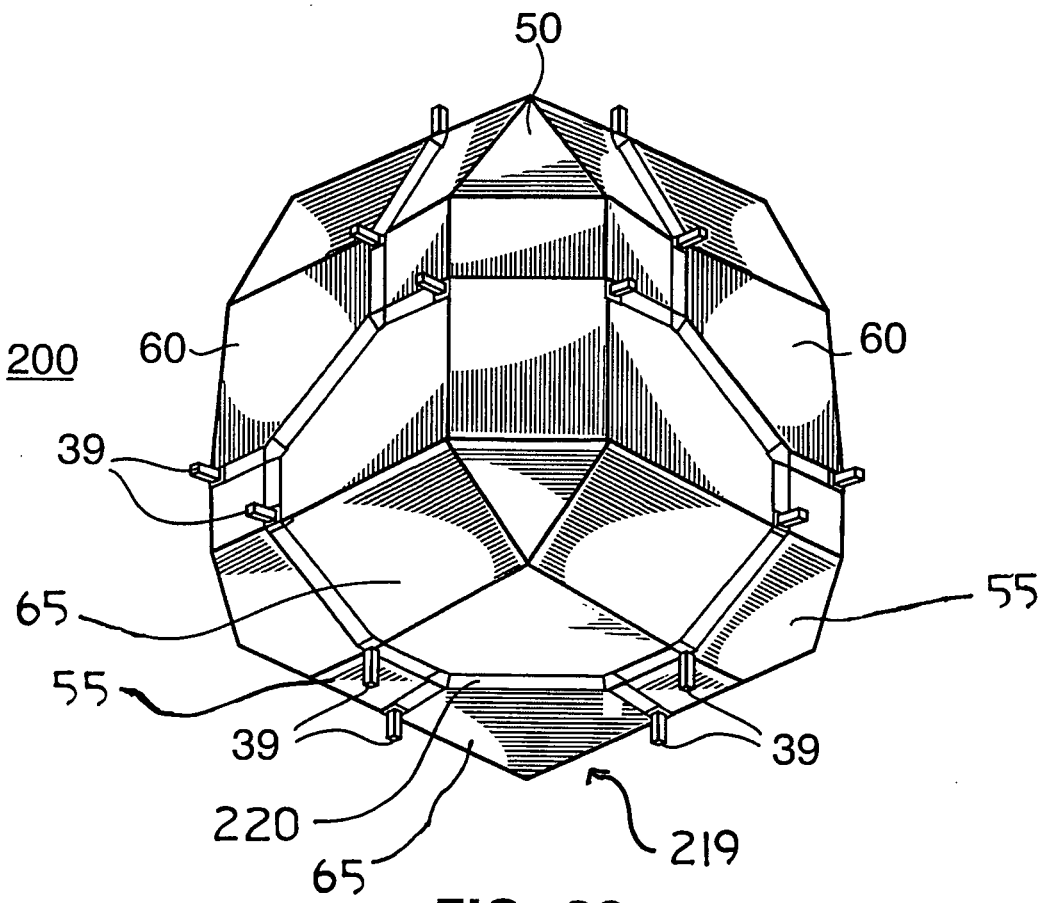
FIG. 20 is perspective view of the bottom side of the rhombicuboctahedron with corner panels flush with outer surface of the double-Y framework.

Using any selected one of the three attachment means presented in FIGS. 17-19, a user has a choice as to whether to locate the corner panel members 40, 50, 60 and 80 on or flush with the exterior or the interior surface of the double-Y framework. FIGS. 13-15 show the corner panel members attached to the interior or inward facing sides of the double-Y framework. FIG. 20 shows panel members 50 and 60 attached flush with the exterior surface of the double-Y framework.

Figure 21:
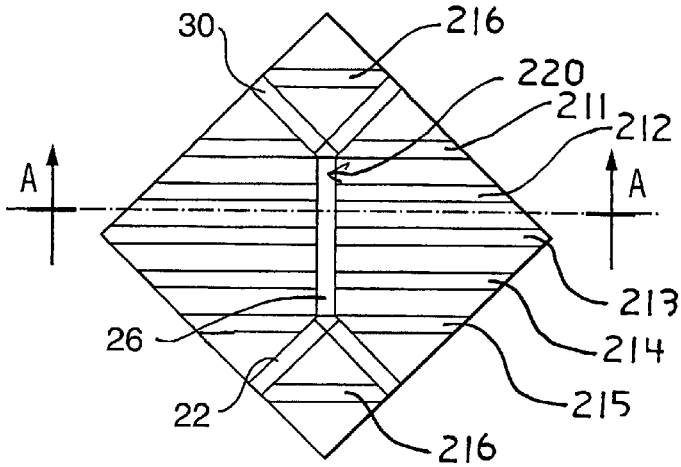
FIG. 21 is a top view of a flooring system for a rhombicuboctahedron.
Figure 22:
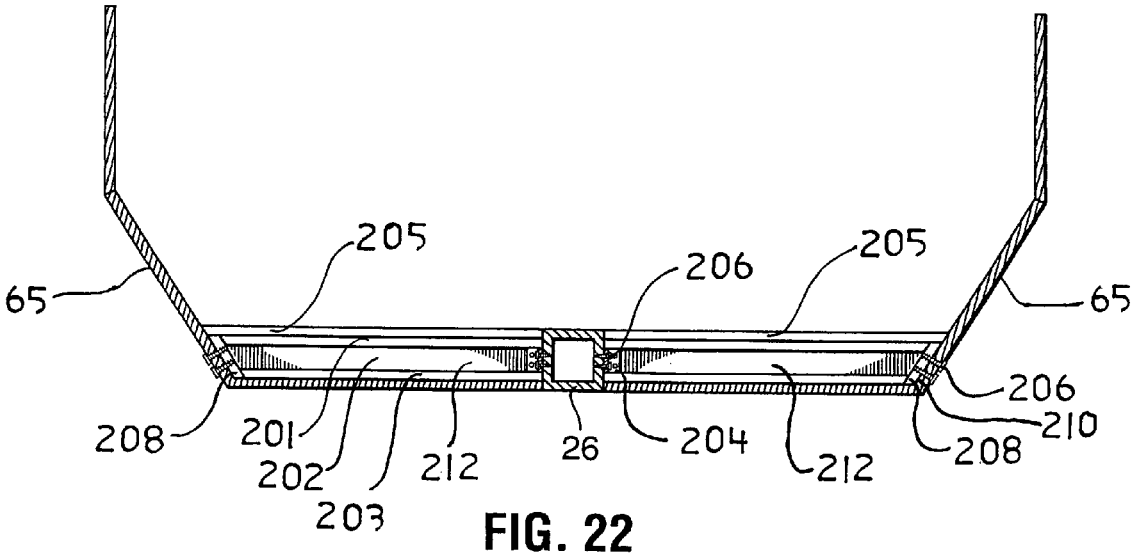
FIG. 22 is a cross sectional view of the flooring system in the direction of arrows 'A' in FIG. 21, including I-beams, angle irons, floor panel, corner panels, and square tubing member.

FIG. 20 shows a bottom view of yet another embodiment, rhombicuboctahedran 200, which has rhombicuboctahedral corner panel members attached flush with the outside surfaces of the double-Y elements. A reinforced flooring system is shown in FIGS. 21 and 22 wherein I-beams are attached to the double-Y element 220 on the bottom side 219 of the rhombicuboctahedran 200 which has been chosen to be used as a floor. Bottom side 219 is square and includes the outer surface of double-Y element 220, portions of large rhombicuboctahedral corner panel members 65 and portions of small rhombicuboctahedral corner panel members 55.

In FIG. 22, I-beam 212 includes a web 202, and upper flange 201 and a lower flange 203. At one end of the I-beam 212, the web of I-Beam 212 is attached to the square tubing 26 by angle iron 204 with self drilling screws 206. The other end of the I-beam 212 is double mitered with an end plate 208 rigidly attached and configured to lie flat against a lower inside corner 210 of corner panel member 65. It is anticipated that the end plate 208 is welded to the double mitered end of I-Beam 212, but angle brackets and screws may be used if desired. End plate 208 is then attached to corner 210 of corner panel member 65 with self drilling screws 206. All flooring I-beams 211-216 are double mitered as needed and attached to double-Y element 220 and corner panels 55 and 65 in a similar way. Once the I-beams are attached, the flooring panels 205 are attached to the I-beams and double-Y element 220 with screws, adhesives, welding or any appropriate method of attachment.

It is anticipated that such a reinforced flooring system could be included on other selected sides of rhombicuboctahedran 200 for the purpose of reinforcing all the sides. Further, any selected side or sides of cube 90 could be reinforced in a similar manner with a similar system of I-beams and floor panels.

It is understood that the framework supporting the structures in FIGS. 13 and 14 may be expanded by adding more double-Y elements, as shown in FIG. 15, and panel portions 40, 50, 60, and 80 as desired so that cubes and rhombicuboctahedrons may be connected as desired, forming an unlimited number of combined and/or separate volumes within a connected framework.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A double-Y modular framing construction system comprising:

a plurality of double-Y elements connected at the endpoints of respective double-Y elements at right angles to one another, said plurality of double-Y elements forming a double-Y framework circumscribing a plurality of volumes in three specific shapes including a first cube, a second cube and a rhombicubocatahedron, each of said double-Y elements comprising four short longitudinal elements of a given length A, one long longitudinal element of a length equal to the square root of two multiplied by A, and two modular Y joints wherein first free ends of a first two of said four short longitudinal elements and a first free end of said long longitudinal element are rigidly connected at the three ends of a first of said two modular Y joints, said first two longitudinal elements forming a 90° angle with one another and said long longitudinal element forming a 135° angle with each of said first two short longitudinal elements, a second one of said two modular Y joints rigidly connected to the first free ends of a second two of said four short longitudinal elements and to the free end of said long longitudinal element, said second two short longitudinal elements forming a 90° angle with one another and said long longitudinal element forming a 135° angle with each of said second two short longitudinal elements;

a plurality of first cubic corner panel portions;

a plurality of second cubic corner panel portions;

a plurality of first rhombicuboctahedral corner panel portions;

a plurality of second rhombicuboctahedral corner panel portions; and wherein selected ones of said panel portions are assembled to define said double-Y framework consisting of three specific shapes including a first cube, a second cube and a rhombicuboctahedron within said double-Y framework and wherein all adjacent peripheral edges of said first cubic corner panel portions, said second cubic corner panel portions, said first rhombicuboctahedral corner panel portions, and said second rhombicuboctahedral corner panel portions lying adjacent to said short and said long longitudinal elements composing said double-Y elements are attached to said short and said long longitudinal elements.

2. The double-Y modular framing construction system of claim 1 wherein said short longitudinal elements and said long longitudinal elements are formed from tubing.

3. The double-Y modular framing construction system of claim 2 wherein said modular Y joints include lugs at the three ends sized to receive the free ends of said short longitudinal members and said long longitudinal members.

4. The double-Y modular framing construction system of claim 3 wherein said tubing and said lugs are square.

5. The double-Y modular framing construction system of claim 1 wherein said short longitudinal members and said long longitudinal members forming said double-Y framework, support said adjacent peripheral edges of said first cubic corner panel portions, said second cubic corner panel portions, said first rhombicuboctahedral corner portions, and said second hombicuboctahedral corner portions comprise selected cubic and rhombicuboctahedral volumes within said double-Y framework.

6. The double-Y modular framing construction system of claim 5 wherein said adjacent peripheral edges of said panel portions are permanently fitted with flanges extending out from and parallel to outer surfaces of said panel portions.

7. The double-Y modular framing construction system of claim 6 said flanges attaching to said longitudinal members supporting said panel portions.

8. The double-Y modular framing construction system of claim 5 wherein edges of said panel portions are attached to said longitudinal members with self drilling screws.

9. The double-Y modular framing construction system of claim 5 wherein the flat surfaces of T-flanges are in communication with opposing lateral surfaces of said longitudinal members and are attached with self drilling screws and wherein corner panel portions are attached to lateral surfaces of said T-flanges with self drilling screws.

10. The double-Y modular framing construction system of claim 9 wherein exterior surfaces of said first rhombicuboctahedral corner panel portions and said second cube of a greater size than said first cube rhombicuboctahedral corner panel portions of said rhombicuboctahedran are flush with the outward facing surface of said double-Y elements forming said framework circumscribing said rhombicuboctahedran.

11. he double-Y modular framing construction system of claim 10 wherein a selected square side of said rhombicuboctahedran includes a reinforced flooring system comprising parallel I-beams, a first end of said I-beams being attached perpendicular to lateral sides of a double-Y element contained within said selected square side, a second end of said I-beams mitered and fitted with an end plate which lies flat against the adjacent inside corner of a rhombicuboctahedral corner panel portion forming said selected square side, said end plate being fixedly attached to said rhombicuboctahedral corner panel portion, and floor panels covering said I-beams being attached to the upper flange of said I-beams.

12. A double-Y modular framing construction system comprising:

a plurality of double-Y elements connected at the endpoints of respective double-Y elements at right angles to one another, said plurality of double-Y elements forming a double-Y framework circumscribing a plurality of volumes in three specific shapes including a first cube, a second cube of a greater size than said first cube and a rhombicuboctahedron, each of said double-Y elements consisting of four short longitudinal elements of a given length A, one long longitudinal elements of a given length B wherein B is greater than A, and two modular Y joints wherein first free ends of a first two of said four short longitudinal elements and a first free end of said long longitudinal element are rigidly connected to the three ends of a first of said two modular Y joints, said first two longitudinal elements forming a 90° angle with one another and said long longitudinal element forming a 135° angle with each of said first two short longitudinal elements, a second one of said two modular Y joints rigidly connected to the first free ends of a second two of said four short longitudinal elements and to the free end of said long longitudinal element, said second two short longitudinal elements forming a 90° angle with one another and said long longitudinal element forming a 135° angle with each of said second two of four short longitudinal elements;

a plurality of first cubic corner panel portions;

a plurality of second cube corner panel portions of a greater size than said first cube corner panel portions;

a plurality of first rhombicuboctahedral corner panel portions;

a plurality of second rhombicuboctahedral corner panel portions; and wherein selected ones of said panel portions are assembled defining said double-Y framework comprising said three specific shapes including a first cube, a large second cube and a rhombicuboctahedron within said double-Y framework.

13. The double-Y modular framing construction system of claim 12, wherein wherein all adjacent peripheral edges of said first cubic corner panel portions, said second cubic corner panel portions, said first rhombicuboctahedral corner panel portions, and said second rhombicuboctahedral corner panel portions lying adjacent to said short and said long longitudinal elements composing said double-Y elements are attached to said short and said long longitudinal elements.

14. The double-Y modular framing construction system of claim 12 wherein said short longitudinal elements and said long longitudinal elements are formed from tubing.

15. The double-Y modular framing construction system of claim 13 wherein said modular Y joints include lugs at the three ends sized to receive the free ends of said short longitudinal members and said long longitudinal members.

16. The double-Y modular framing construction system of claim 13 wherein said tubing and said lugs are square.

17. The double-Y modular framing construction system of claim 12 wherein said short longitudinal members and said long longitudinal members forming said double-Y framework, support said adjacent peripheral edges of said first cubic corner panel portions, said second cubic corner panel portions, said first rhombicuboctahedral corner portions, and said second hombicuboctahedral corner portions comprise selected cubic and rhombicuboctahedral volumes within said double-Y framework.

18. The double-Y modular framing construction system of claim 12 wherein said adjacent peripheral edges of said panel portions are permanently fitted with flanges extending out from and parallel to outer surfaces of said panel portions.

19. The double-Y modular framing construction system of claim 18 said flanges attaching to said longitudinal members support said panel portions.

20. The double-Y modular framing construction system of claim 18 wherein the flat surfaces of flanges are in communication with opposing lateral surfaces of said longitudinal members and are attached with self drilling screws and wherein corner panel portions are attached to lateral surfaces of said flanges with self drilling screws.

21. The double-Y modular framing construction system of claim 20 wherein an exterior surface of said first rhombicuboctahedral corner panel portions and said second cube of a greater size than said first cube rhombicuboctahedral corner panel portions of said rhombicuboctahedran are flush with the outward facing surface of said double-Y elements forming said framework circumscribing said rhombicuboctahedran.

22. The double-Y modular framing construction system of claim 12 wherein a selected side of said rhombicuboctahedran includes a reinforced flooring system comprising parallel I-beams, a first end of said I-beams being attached perpendicular to lateral sides of a double-Y element contained within said selected square side, a second end of said I-beams mitered and fitted with an end plate which lies flat against the adjacent inside corner of a rhombicuboctahedral corner panel portion forming said selected square side, said end plate being fixedly attached to said rhombicuboctahedral corner panel portion, and floor panels covering said I-beams being attached to the upper flange of said I-beams.

* * * * *